United States Patent [19]

Hatherley

[11] Patent Number: 4,522,407

[45] Date of Patent: Jun. 11, 1985

[54] FINANCIAL BOARD GAME

[76] Inventor: Bruce E. Hatherley, 2 Little Nicholson St., Balmain NSW 2041, Australia

[21] Appl. No.: 655,315

[22] Filed: Sep. 27, 1984

Related U.S. Application Data

[63] Continuation of Ser. No. 227,897, Jan. 23, 1981, abandoned.

[51] Int. Cl.[3] ..... A63F 3/00

[52] U.S. Cl. ..... 273/256

[58] Field of Search ..... 273/256, 254, 243

[56] References Cited

U.S. PATENT DOCUMENTS

| | | | |
|---|---|---|---|
| 2,571,403 | 10/1951 | Aird | 273/256 |
| 2,691,528 | 10/1954 | Laidlaw | 273/256 |
| 3,740,037 | 6/1973 | de Bono | 273/256 |
| 3,765,682 | 10/1973 | Braude | 273/256 |
| 3,885,792 | 5/1975 | Breslow | 273/256 |
| 4,062,545 | 12/1977 | Witney | 273/239 |
| 4,065,131 | 12/1977 | Martin, Jr. et al. | 273/243 |
| 4,397,467 | 8/1983 | Thornton | 273/256 |

OTHER PUBLICATIONS

"The Abscam Game", Washington Star Newspaper, May 30, 1980, p. A-2.

*Primary Examiner*—Richard C. Pinkham
*Assistant Examiner*—Scott L. Brown
*Attorney, Agent, or Firm*—Beveridge, DeGrandi and Weilacher

[57] ABSTRACT

A board game of the kind wherein players are represented by pieces movable on a board along a track of main stations. The number of stations is selected by chance prior to each piece's movement and each player may effect financial transactions, the nature of which transaction depends on the main station on which each player's piece lands. The game includes two tracks of main stations, four transit stations enabling movement from one track to the other and a track of index stations along which an index token may move to modify the purchasing power of the currency by which the transactions are effected. One of the two main tracks has a higher proportion of a first type of main station and a lower proportion of a second type of main station than the other main track. Players elect a President who, subject to Congress, determines tax rates and like matters. Players may buy, sell and rent property, effect insurances, attempt take-overs of other's property, raise loans, buy and sell bonds in simulation of economic competition in a free enterprise society.

21 Claims, 3 Drawing Figures

FINANCIAL BOARD GAME

This application is a continuation of application Ser. No. 227,897, filed Jan. 23, 1981, now abandoned.

FIELD OF THE INVENTION

This invention relates to board games of the kind typified hitherto by the well-known board game marketed under the registered trade mark "Monopoly" in which players are in pseudo financial competition with each other and in which the winner is the player who remains financial whilst reducing all other players to bankruptcy.

BACKGROUND OF THE INVENTION

The game of "Monopoly" is played on a board having an endless track of stations along which pieces representative of each player are moved by distances determined by the throw of dice. Almost all of the stations represent pieces of real estate which the player whose piece lands on the station may purchase, if it has not already been purchased by another player, and which subject to the rules of the game he may develop and in respect of which he may charge rent from any player whose piece thereafter happens to land on the station concerned. At the start of play each player is issued with a sum of money and usually receives further money each time his piece completes a circuit of the stations. In the game of "Monopoly" a few of the stations do not represent pieces of property but more or less arbitrarily indicate a benefit or a forfeit applicable to the player whose piece lands on one or other of those few stations.

To some degree then the game of "Monopoly" simulates financial or economic competition between the players.

By comparison the present invention aims at providing a higher degree of simulation and, at least in its preferred embodiments, brings into the simulation more of the factors affecting the economic and social life of a community than those of "Monopoly". For example, in its preferred embodiments the present game enables players to seek loans, take out insurance policies, it provides for competition between the players through legislative action, and most important of all takes into account inflation and deflation, that is to say, those fluctuations in the purchasing power of currency which occur from time to time as a result of economic forces largely beyond the control of any individual.

SUMMARY OF THE INVENTION

Thus, in its broadest aspect the invention consists in a board game of the kind wherein players are represented by pieces movable on a board along a track of main stations by a number of stations selected by chance prior to each piece's movement and wherein each player may effect financial transactions in relation to one or more of the other players, the nature of which depends on the main station on which said each player's piece lands, characterised in that the purchasing power of the currency by which such transactions are effected is modified in accordance with an index the magnitude of which is varied from time to time in a random manner.

In peferred embodiments the index is varied in consequence of the chance landing of a piece on one or more designated main stations.

In such preferred embodiments the magnitude of the index is indicated by the position of a token movable from time to time along a track of index stations which display index values, the movement of the token occurring when a piece lands on a designated main station and being defined in terms of the number of index stations by a number appearing on the designated main station concerned.

According to still further preferred embodiments the various index stations not only designate a numerical index to be applied to the value of the currency but also dictate the occurrence of various critical events affecting all players, for example the payment of tax or the compulsory repayment of loans previously incurred or the like.

DESCRIPTION OF THE PREFERRED EMBODIMENT

Figure 1:
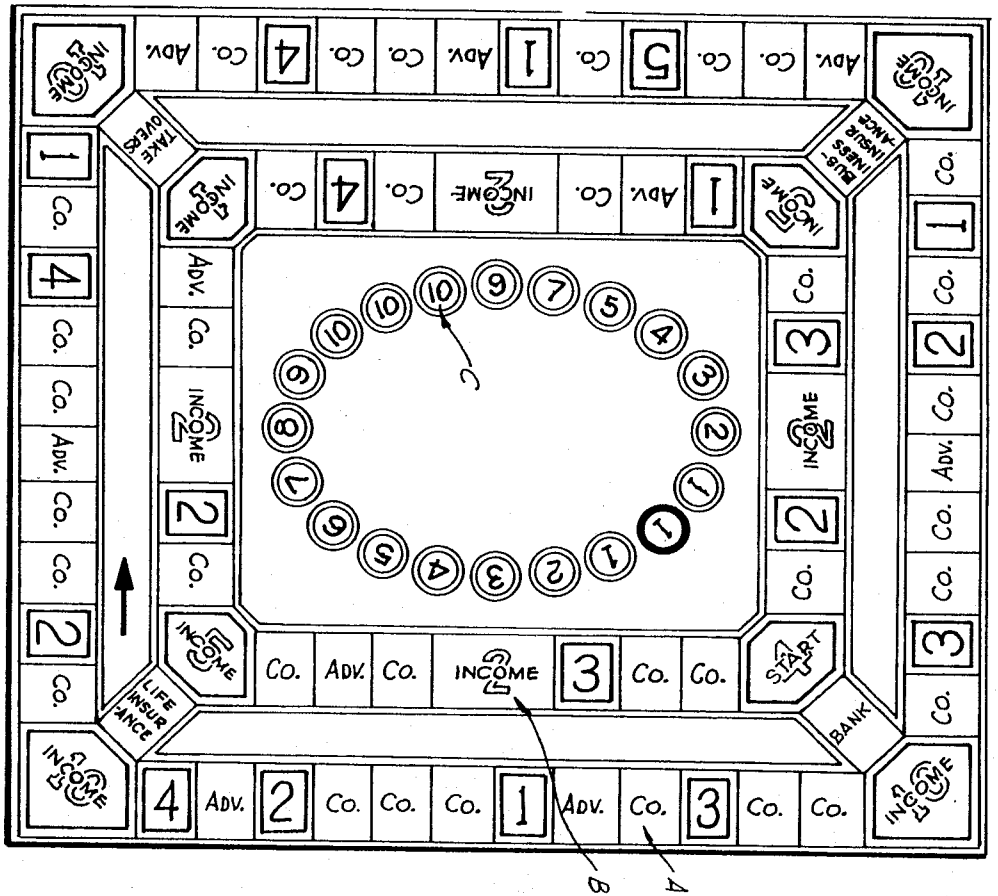
FIG. 1 illustrates a game board constructed according to the invention.
Figure 2:
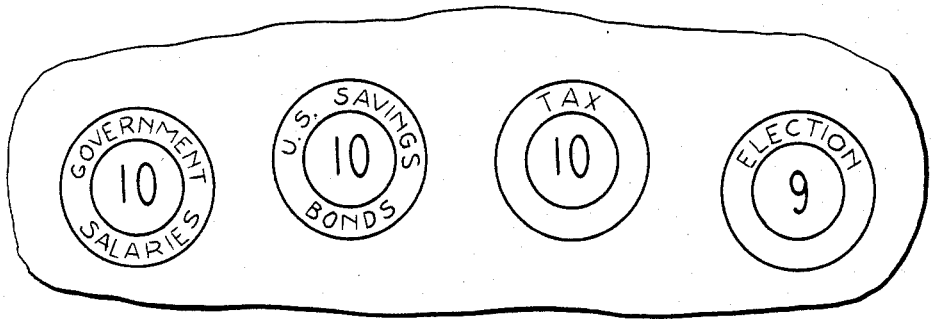
FIG. 2 shows a portion of the index track of the game board, enlarged to illustrate the indicia associated with the stations thereon.
Figure 3:
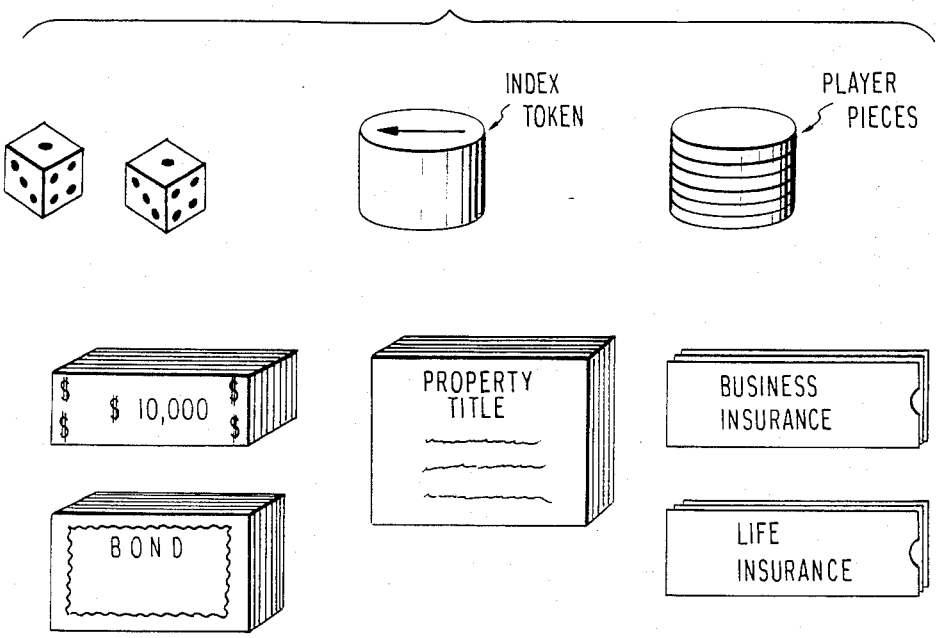
FIG. 3 shows various items which are used in connection with the game.

By way of example, an embodiment of the invention is described more fully hereinafter with reference to the accompanying drawing, being a plan view of a board on which the game may be played.

As indicated at the outset preferred embodiments of the game of the present invention simulate the economic and social activity of a real community or nation and for convenience of description, terms such as for example, "President", "Government Savings Bonds", "Company Profits", "Advertising medium", "Money" "Bank" and "Title deed" are used hereinafter with reference to a board station, printed card or paper slip as if the station, card or slip were the actuality that it represents. The rules of play of the game now being described will be apparent from what follows in that the rules of play and the nature of the game are inextricably related.

The example of the invention described below is suitable for from 2 to 6 players and the "hardware" necessary to enable the game to be played may comprise printed paper slips representing money of the following quantities and denominations, namely forty 10,000 dollar notes, thirty 20,000 dollar notes, sixty 50,000 dollar notes, eighty 100,000 dollar notes and eighteen one million dollars notes, printed cards representing various commercial documents namely forty-five property title deeds, thirty government bonds, five business insurance policies, five life insurance policies, the printed playing board shown in the drawing herewith, six individually identifiable player's pieces, one index token and two dice each having sides numbered 1 to 6 respectively.

As can be seen from the drawing the board displays three tracks of stations namely an outer main track A, an inner main track B and an index track C. The two main tracks are linked at the four corners of the board by four corner stations on which the words "bank", "business insurance", "take-over" and "life insurance" appear respectively.

The stations of the index track, referred to below as index stations, each display a numerical multiplier index and the index token is moved intermittently along that track in a manner which will be described hereinafter and its position on any one of the index stations at any time indicates that the index appearing on that particular station is at that time the operative multiplier, affecting the value of the currency.

The various stations of the tracks A and B require to be named to facilitate the later description. Those stations comprise 19 "index token activating stations" each of which displays a number within a rectangle. Of those activating stations there are five which are numbered 1, five which are numbered 2, four which are numbered 3, four which are numbered 4 and one which is numbered 5.

There are twelve "income stations", eleven of which have the word income written on them and the twelfth has the word start written on it. In addition each income station shows an income multiplier number there being one income station numbered 1, four numbered 2, one numbered 4 (being the one which bears the word start), two numbered 5 and four numbered 10.

Finally there are 45 "property stations", 35 of which represent public ocmpanies ("company stations") and have the word Co. on them and 10 of which represent advertising media and have the word ADV written on them ("media stations").

The index stations not only display a multiplier but also indicate various specific events which take place whenever the index token rests upon an index station dictating that event. For example, some index stations bear indicia calling for an election, others bear indicia requiring that government salaries be paid, others bear indicia requiring that interest be paid on any government bonds that have been issued and the remainder bear indicia requiring that tax is payable.

At the start of play the index token is placed upon the election 1 station of the index stations. The token has an arrow on it which indicates the direction it is to be moved around the index track when movement becomes due.

Each player then choses a piece and places it on the income station having the word start written on it with the pieces facing in the direction of play, for example in a clockwise direction.

One of the players is chosen to be banker. All of the money, property title deeds, and insurance policies are placed within the banker's care for him to administer the issue and receipt of same throughout the game.

The government bonds are placed to one side for inclusion in the government treasury pending an election.

For preference all players have writing material available so that they can record items such as their basic income for the better control of their play.

Starting with the banker each player throws two dice to determine his basic income which is the number thrown multiplied by, say, ten thousand dollars. Thus if a player throws a dice total 5, his basic annual income will be 50,000 dollars. Double dice, that is to say a throw in which both dice indicate the same number, do not entitle a player to another throw and basic incomes are fixed for the duration of the game.

As the start station is also an income station and has the multiplier 4 thereon so the banker now pays all players four times their income at the start of the game. As play progresses the banker pays income to each player whenever that player's piece lands on an income station and in each instance the player's basic income is multiplied by the multiplier indicated on the particular income station concerned.

One, two or three of the four income stations of track A are designated as providing an additional benefit as described hereinafter.

As the index token is initially placed on an election index station the first election is held at the start of play. Throughout the game, whenever the index token lands on an election index station, normal play is halted and players vote for a new government.

At an election players may combine to form political parties or may choose to remain independent. For example, players with higher incomes may decide to form one party while players with lower incomes another. Each player now throws the dice and the number thrown indicates the number of seats the player has in Congress. During an election throw of double dice entitles the player to another throw. The banker may throw the dice first followed by the other players in a clockwise direction. Each player records the number of seats he has in Congress while the banker totals the results. The winner of the election is the player or, more likely, the party or upon agreement between parties, the coalition, commanding a majority number of votes. If no majority can be determined the election is a nullity and dice should be thrown again by all players. One player in the winning party or a majority coalition of parties or the winning independent, is nominated President. If the role of President is contested within a winning party he is the member of the Governing group with the greatest personal voting strength. Elections can only be held when the index token lands on an election index station and the President once determined remains President until at least the next election.

After the initial or each election each player has a certain number of seats which is his voting power in Congress until the next election. The number of seats a player controls should be recorded and changed after each election. Any tax rates, tax rebates or government salaries introduced by the President must be passed by a majority of votes in Congress to become law; in the absence of action to modify tax rates a standard rate of, say $30,000 per company owned by each player shall be paid. After a new election old tax rates introduced by the former government apply until new tax rates are passed by the new Congress. Congress is convened only when the President uses his turn to introduce or to attempt to introduce some new tax rates, tax rebate or change in government salaries. A parliamentary session is over when the President finishes his turn.

The President has a dual role in the game, playing as both as an individual player and as President. Inter alia, is responsible for collecting taxes and controlling the direction of the movement of the index token which he can change if he pleases whenever it is his turn to play. The President may also use his turn to stimulate the economy by issuing a tax rebate to all players or to players of his choice. It can be of any amount and is payed from the treasury.

The President may determine his own government salary. However, it cannot be less than, say, 100,000 dollars. The President need only consult Congress if he increases his government salary above that minimum value. He may also appoint other players to be Presidential Advisers and pay them accordingly when the index token lands on an index stations calling for the payment of government salaries and the amounts payable to each Adviser must be recorded by the President before the index lands on such a station.

If no names or amounts have been recorded then only the President's minimum salary is payable when the index token lands on an index station calling for the payment of government salaries.

Government salaries are paid from the treasury. The President does not need to consult Congress on the appointment of Advisers but must consult Congress on the value, or changes in value of their government salaries.

The President administers the treasury which at the start of play has 3 million dollars in government bonds in denominations of 100,000 dollars. The President needs cash to pay government salaries and also to issue any tax rebates. At the start of the game there is no cash in the treasury but the President may sell some government bonds to the bank for their face value in cash. The President may only do this during his turn and cannot sell bonds direct to players although players can buy them from the bank. The President may also buy bonds back from the bank at face value so long as interest is not due or from players at twice face value so long as interest is not due. Interest becomes due when the index token lands on an index station indicating that bond interest is payable and the government must pay both the bank and the players their interest either with cash or by issuing more bonds to the bank. If the treasury cannot pay the interest it is bankrupt, the currency is worthless and the game is over without a winner.

The President must keep his own cash and assets separate from the treasury. The President does not need to consult Congress to issue or repurchase any government bonds but may do so only during his turn. At the next election the retiring President must hand the contents of the treasury to the new President who inherets the former President's handling of the economy.

When the index token lands on an index station showing taxation is payable all players including the President must pay tax to the treasury. The amount payable is determined by the President. It may be a rate calculated on the number of companies and/or advertising media players may own, or it may be an income tax with different amounts payable by each player based on their ability to pay, or a combination of both. The President may exempt certain players from tax to provide more opportunity for players on low incomes, or to provide concessions to players with high incomes to stimulate investment. The President needs tax to pay government salaries, tax rebates, as well as interest on any issued government bonds. The more bonds the President issues or the higher he makes government salaries, then the higher the tax rates are likely to be. The President must be careful not to hinder economic growth with high taxes as well as avoid bankrupcy by keeping the treasury solvent. Tax rates must be recorded by the President prior to the index token landing on an index station marked taxation otherwise no tax is payable.

Players need only pay tax to the extent that they have cash available and assets do not have to be sold to meet tax payments. Assets include companies, advertising media, bonds and insurance policies.

As stated above, the index token is activated, that is to say shifted along the track of index stations, whenever a piece lands on an index activating station and the move has to be made in the direction which the arrow on the index token is then pointing and for a number of index stations equal to the number on the index activating station which became effective because of a piece landing on it.

The President at the start of the game and whenever it is his turn to play may rotate the index token to alter its direction of travel from that point on. He can do this without requiring to consult Congress. Whenever the index token is activated the President must move the index token the requisite distance and then respond to the situation indicated on the index station reached, unless of course the situation indicated is the calling of an election where upon an election must be held and play then returns to the next player.

At the start of the game all players' pieces are positioned on the income station marked start and after being elected the President has the first throw. Like all players he has two options he may throw the dice and move around the track he is currently positioned on for the number of stations indicated by the dice or without throwing the dice he may simply place his piece on any one of the four corner stations. If he opts to do the latter then on his next turn he may move his piece around either of tracks A or B as he chooses. Apart from index acitvating stations and income stations pieces moving around the tracks A and B will land on company stations and media stations. Pieces may not land on any of the four corner station due to the throwing of the dice.

If a player's piece lands on an unowned company or media station he may buy it for its current indexed value which is in the case of companies, say 100,000 dollars and in the case of media, say 10,000 dollars multiplied by the current index number as indicated by the position of the index token. Companies and media may only be purchased outright and the money is paid to the banker in exchange for a title deed. The owner of a company must be paid profits by any player whose piece subsequently lands on it. The amount payable when landing on nother player's company is the same as the company's current indexed value. A player is only liable to pay profits to another player to the extent that he has cash available and need not sell assets to pay, a player whose piece lands on his own company station receives company profits at the current value from the bank. Companies have no resale value to the bank but may be sold for any amount amongst players.

A player owning a media station may direct other players' pieces which land on it to any company station he may own and as a result be paid company profits.

A player owning an media station may also redirect his own piece landing on it to any company or other media station on either track A or B. The advantage gained is that players may use media stations to purchase other advertising media or companies or receive company profits from the banker at the current indexed value if he directs his piece to a company that he already owns. Media stations have no resale value to the bank but may be sold for any amount amongst players.

Should a player whose piece lands on an unowned company or advertising media station be unable to, or choose not to, purchase the station it is auctioned to the highest bidder regardless of the current indexed value. It does not matter whether the station is sold for more or less than the current value. The player whose piece landed on the station and was unable to, or chose not to, purchase the station may not participate in the auction.

Players may use their turn to negotiate a loan from another player. Players may borrow any amount from each other at any interest rate. As a guide the interest rate on government bonds is 100%. A player negotiating a loan must do so as a turn and not throw dice or move to a corner station. Players may not negotiate a loan if they have already thrown dice or moved to a corner station. Players may not borrow from the bank.

As mentioned earlier a player positioning himself on any of the four corner station does so as a turn and he may not move to a corner station if he has already thrown dice for that turn.

Players decide to move from one track A to B or vice versa by placing their token on any of the four corner station, may when it is their next turn throw dice and move around either track A or B. Players can use the corner stations simply as a track transit means or if they wish also take advantage of the opportunities that each corner station offers as set forth below.

If a player moves his piece to the corner station marked "bank" he may purchase government bonds from the bank in amounts of, say, 100,000 dollars. Thereafter interest of 100% is payable by the treasury whenever the index token lands on an index station calling for that event.

If the President has issued no bonds to the bank no bonds are available to players. Players may sell any bonds they may hold to the bank for face value.

If a player places his piece on the corner station marked "life insurance" he may buy a life insurance policy. Each policy costs, say, 100,000 dollars which is payable to the bank and matures at the end of the game for, say, 1 million dollars. Only one policy may be purchased in any one turn, but players may hold more than one life insurance policy. Should players wish to cash their policies before they mature they may surrender them to the bank for, say, 80,000 dollars. Life insurance may not be sold amongst players.

If a player places his piece on the corner station marked "business insurance" he may purchase a business insurance policy. Business insurance provides protection against a business disaster which is deemed to occur if a player throws double 6 dice. Players who throw double 6 dices who have not taken out business insurance automatically loose all their assets to the bank except life insurance which may be retained. A player who has a business disaster does not move his token and the next player takes his turn. Business insurance policies are only good for one disaster after which they must be returned to the banker. Only one business insurance policy may be purchased and held at any one time. Business insurance policies may not be sold amongst players.

If a player placed his piece on the corner station marked "take-over" he may attempt to take over any company owned by another player he does this by paying, say, 30,000 dollars to the bank which is not refundable and then throwing his two dice. If double dice are thrown the take-over is successful and the player may acquire the company he nominated by making a payment equal to half its current indexed value to the former owner. If the player does not throw double dice then the take-over bid was not successful and it is the end of his turn. Only one company can be taken-over in any one turn. Media stations may not be taken over. A double 6 dice thrown during a take-over bid does not constitute a business disaster.

As mentioned earlier, certain of the income stations on the outer track A are designated as opportunity station. This means that in addition to receiving income a player whose piece lands on one such station may direct his piece to any other station of his choice except another opportunity station, for example, a player could direct his piece to an income station endorsed with a multiplier of 10 and receive ten times his income. As all opportunity stations are themselves income stations with multipliers of 10 a player sending his piece to another income station with a multiplier of 10 would receive twenty times his income in the one turn, or he could send his piece to a company or media station he may want to buy, or receive profits from the bank for sending his piece to a company station he already owns. Then again the player may direct his piece to an index activating station which in turn could increase or decrease prices as well as, perhaps, move the index to a desired politcial event such as an election.

To determine who is the winner at the end of the game players total all cash and bonds plus any life insurance policy, all of which are deemed to mature at the end of the game. The value of companies or media is determined by multiplying the number of relevant title deeds held by their current indexed value. Business insurance has no value at the end of the game. The game is over once the bank's money supply is exhausted.

Alternatively if desired the game can be played within a predetermined time limit between two groups of players to determine which group can produce the biggest gross national product. The gross national product is the total amount of cash in the game minus the deficit, that is outstanding government bonds, if their is a surplus in the treasury then that is added to the total gross national product. The gross national product determines both the level of enterprise and good government.

I claim:

1. Apparatus for playing a game wherein players conduct private and governmental financial transactions, said governmental financial transactions being determined by a player or players who serve as a governmental authority to levy taxes and/or sell government securities, comprising, two main tracks provided with a plurality of stations including property stations which are marked to represent different properties, both of said main tracks being provided with income stations which are marked to indicate that income is to be paid to a player whose marker lands thereon, one said main track having a higher proportion of property stations and a lower proportion of income stations than the other main track, whereby a player may affect his financial strategy by selecting one of the main tracks for movement of his marker, player markers movable along said main track to indicate the stations occupied by the players, means for providing a chance selection of the number of stations to be moved by the player markers on the main track, means for conducting private and governmental financial transactions, index indicating means for providing a randomly variable index of the purchasing power of currency, said index indicating means comprising a plurality of index stations which represent said index, at least one of said stations including means for dictating that the players conduct an election to select a new governmental authority.

2. Apparatus according to claim 1 wherein each of said index stations is provided with, in addition to the index indicating means, means for ordering the occurrence of an event which affects all players, one said event being a governmental election, other said events being payments to and from the players.

3. Apparatus according to claim 1 wherein the index stations form an endless index track wherein, in one direction of travel, the indicies ascend from station-to-station in sequential numerical order to the highest index and then descend in non-sequential numerical order to the lowest index.

4. Apparatus for playing a game wherein players conduct financial transactions, comprising, two main tracks provided with a plurality of stations including property stations which are marked to represent different properties, both of said main tracks being provided with income stations which are marked to indicate that income is to be paid to a player whose marker lands thereon, one said main track having a higher proportion of property stations and a lower proportion of income stations than the other main track, whereby a player may affect his financial strategy by selecting one of the main tracks for movement of his marker, player markers movable along said main track to indicate the stations occupied by the players, means for providing a chance selection of the number of stations to be moved by the player markers on the main track, means for conducting financial transactions relating to properties associated with the property stations occupied by the marker of a player on the main track, index indicating means for providing a randomly variable index of the purchasing power of currency, said index indicating means comprising a plurality of index stations which represent said index, said index stations also including event-dictating means for ordering the occurrence of at least one critical event affecting all players.

5. Apparatus according to claim 4 wherein the event-dictating means on at least one index station is operable to order the occurrence of a governmental election.

6. Apparatus according to claim 4 wherein the event-dictating means on the index stations order the occurrence of (a) a governmental election, (b) the payment of tax, (c) the payment of government salaries and (d) the payment of interest on government bonds.

7. Apparatus according to claim 4 wherein the index indicating means includes an index marker which is movable along said index stations, said index marker having a direction indicator thereon so that a designated player may determine and change the direction of movement to be taken by the index marker.

8. Apparatus according to claim 7 wherein some of said stations on the main track are provided with means for dictating the number of index stations to be traversed by said index marker on said index indicating means.

9. Apparatus according to claim 4 wherein the main track includes stations which are provided with means for indicating changes in the state of said index indicating means.

10. Apparatus according to claim 9 wherein the index stations are arranged in a track, an index token movable along said track of index stations, said means for indicating changes in the state of said index indicating means comprising markings on the main track which indicate the number of index stations to be moved by said index token.

11. Apparatus according to claim 4 wherein there is at least one transit station linking said main tracks so that a player may move from one main track to the other by placing his marker on said transit station in lieu of his normal turn to play.

12. Apparatus according to claim 11 wherein said income stations on the one said main track are marked with means indicating higher incomes than the income stations on the other main track.

13. Apparatus according to claim 11 whaerein said transit station is provided with means for authorizing the player to effect a transaction indicated thereby.

14. Apparatus according to claim 13 wherein there are four said transit stations, and the means for authorizing the player to effect transactions are operable respectively to authorize the player to (a) purchase life insurance, (b) take-over the property of another player upon meeting a further condition, (c) purchase business insurance and (d) do business with a bank.

15. Apparatus according to claim 4 wherein the main track includes property stations which are marked to indicate that a player whose player marker lands thereon may be dictated by the owner thereof to move to any other property station.

16. Apparatus according to claim 4 wherein, in a plurality of said index stations, each index station both indicates said index and has a said event-dictating means.

17. Apparatus according to claim 4 wherein the index stations form an endless index track wherein, in one direction of travel, the indicies ascend from station-to-station in sequential numerical order to the highest index and then descend in non-sequential numerical order to the lowest index.

18. Apparatus for playing a game wherein players conduct financial transactions, comprising, index indicating means for providing a randomly variable index of the purchasing power of currency, said index indicating means comprising an index track which has a plurality of index stations representing different values of said index, and an index marker which is movable along said index track, said index marker having a direction indicator thereon so that a designated player may determine the direction of movement to be taken by the index marker, two main tracks provided with a plurality of stations including property stations, income stations and index-changing stations; said property stations being marked to represent different properties, said income stations being marked to indicate that income is to be paid to a player whose marker lands thereon, said index-changing stations being provided with means for dictating the number of index stations to be traversed by said index marker on said index track, one said main track having a higher proportion of property stations and a lower proportion of income stations then the other main track, whereby a player may affect his financial strategy by selecting one of the main tracks for movement of his marker, player markers movable along said main track to indicate the stations on said main track occupied by the players, and means for providing a chance selection of the number of track stations to be moved by the player markers on the main tracks.

19. Apparatus according to claim 18 wherein said income stations on the one said main track are marked with means indicating higher incomes than the income stations on the other main track.

20. Apparatus according to claim 18 wherein said index track is endless and, in one direction of travel, the indicies ascend from station-to-station in sequential numerical order to the highest index and then descend in non-sequential numerical order to the lowest index.

21. Apparatus according to claim 18 wherein said index stations which represent different values for the index are also provided with means for ordering the occurrence of a critical event affecting all players, said critical events including an election, payments to the players and payments from the players.

* * * * *